US006707241B2

(12) United States Patent
Makimoto

(10) Patent No.: US 6,707,241 B2
(45) Date of Patent: Mar. 16, 2004

(54) COLOR CATHODE-RAY TUBE

(75) Inventor: Shuji Makimoto, Kumagaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 78 days.

(21) Appl. No.: 10/152,786

(22) Filed: May 23, 2002

(65) Prior Publication Data

US 2002/0175611 A1 Nov. 28, 2002

(30) Foreign Application Priority Data

May 24, 2001 (JP) ..... 2001-155445

(51) Int. Cl.[7] ..... H01J 29/80
(52) U.S. Cl. ..... 313/402; 313/407
(58) Field of Search ..... 313/402, 404, 313/407

(56) References Cited

FOREIGN PATENT DOCUMENTS

JP 11-45665 2/1999

*Primary Examiner*—Vip Patel
(74) *Attorney, Agent, or Firm*—Oblon, Spivak, McClelland, Maier & Neustadt, P.C.

(57) ABSTRACT

Notches formed in a skirt portion of a shadow mask include a plurality of first notches formed at long side and short side skirt portions and respectively forming first tongue portions at substantially central portions of the respective long side and short side skirt portions, and second notches formed as pairs so as to sandwich respective corner portions of the skirt portion and respectively forming second tongue portions. At the respective corner portions of the skirt portion, assuming that a length from a peripheral edge of a mask surface to welding points of the respective second tongue portions is Lwd, and a length from the peripheral edge of the mask surface to a distal end of at least one second notch is Lcd, Lcd and Lwd have a relationship of Lcd≦Lwd≦2Lcd.

8 Claims, 5 Drawing Sheets

COLOR CATHODE-RAY TUBE

CROSS-REFERENCE TO RELATED APPLICATIONS

This application is based upon and claims the benefit of priority from the prior Japanese Patent Application No. 2001-155445, filed May 24, 2001, the entire contents of which are incorporated herein by reference.

BACKGROUND OF THE INVENTION

1. Field of the Invention

The present invention relates to a color cathode-ray tube having a shadow mask.

2. Description of the Related Art

In general, a color cathode-ray tube includes a glass vacuum envelope which comprises a substantially rectangular panel having an effective portion, a funnel connected to the panel, and a cylindrical neck connected to a small-diameter portion of the funnel. On the inner face of the effective portion of the panel is formed a phosphor screen which includes dot-shaped or striped three-color phosphor layers emitting blue, green, and red lights, and black color light shielding layers. Further, in the vacuum envelope, a shadow mask having many electron beam passage apertures is arranged to oppose the phosphor screen. A an inline type electron gun for emitting three electron beams arranged in a line is located in the neck. A deflecting yoke is mounted from the outer periphery of the neck to the outer peripheral surface of the funnel.

In the color cathode-ray tube having the above-described structure, the three electron beams emitted from the electron gun are deflected horizontally and vertically by means of horizontal and vertical deflecting magnetic fields that are generated by the deflection yoke. The phosphor screen is horizontally scanned at high frequency and vertically scanned at low frequency with the electron beams that are passed through the shadow mask, whereupon a color image is displayed. At this time, the electron beams emitted from the electron gun are projected onto the phosphor screen at a given angle of incidence, and are sorted by the shadow mask in accordance with the angle of incidence on the shadow mask. Therefore, the three electron beams correspond, in a one-to-one correspondence, to the respective colors of red, blue and green of the phosphor screen.

In the color cathode-ray tube described above, the shadow mask is formed in a gradually-curving dome shape, and has a substantially rectangular mask surface in which many electron beam passage apertures having a diameter of about 100 $\mu$m are formed, and a skirt portion extending substantial perpendicularly from the peripheral edge of the mask surface toward the electron gun. Further, the shadow mask is fixed to a mask frame via the skirt portion, and the mask frame is removably supported via elastic supports at stud pins provided on the panel.

Usually, the shadow mask is formed in a desired shape by press molding a flat base mask, in which electron beam passage apertures are formed in advance. Further, the shadow mask is fixed to the mask frame by welding tongue portions, which are respectively formed at the corner portions and the substantially central portions of the long sides and short sides of the skirt portion, to the mask frame, thereby constituting a shadow mask assembly.

In the above-described color cathode-ray tube, in order to reduce doming of the shadow mask at the time of displaying high-intensity images, the shadow mask is formed of Invar material (an iron-nickel alloy) as a low thermal expansion material.

However, in a color cathode-ray tube to be used as a monitor of a computer or the like, reverse display such as window display or the like is general. In a 17 to 19 inch tube, electric current of 500 to 700 $\mu$A is irradiated as an electron beam onto the shadow mask. Therefore, there is much heat generation of the shadow mask, and mask doming cannot be completely prevented.

When the color cathode-ray tube displays a high-intensity image, the directions of the electron beams, which have passed through the electron beam passage apertures of the shadow mask, are changed in the direction of the center of the screen due to the mask doming at the intermediate portion of the screen. Therefore, the beam spots of the electron beams formed on the phosphor screen cannot correctly land on the phosphor layer of the target color, and as a result, the color purity of the formed image deteriorates.

Further, the mask frame is mounted is formed of an inexpensive iron material, from the standpoint of costs. Therefore, the coefficients of thermal expansion of the mask frame and the shadow mask are about 10 times different from each other, and a difference arises in the amounts of thermal expansion of the shadow mask and the mask frame, at the time of high-luminance display.

When the shadow mask assembly is heated at 400 to 500° C. in the manufacturing process, an extremely thin shadow mask is pulled by thermal expansion of the mask frame due to the difference in thermal expansions and the effective portion of the mask locally deforms particular at the vicinities of the welded points between the mask skirt portions and the mask frame. In consideration of such thermal expansion of the mask frame in the heating process, the diameter of the whole skirt portion of the shadow mask is formed larger than the inner diameter of the mask frame so that the skirt portion is pushed into the mask frame when the shadow mask is assembled to the frame, thereby preventing the shadow mask from being deformed in the heating process. In this case, however, as the color cathode ray tube displays high-luminance images, the effective portion of the mask locally deforms toward the electron gun due to the thermal expansion of the frame, in particular at the vicinities of the welded points of the long side portions and the short side portions of the shadow mask. In this case, at the peripheral portion of the screen, the directions of the electron beams, which have passed through the shadow mask, are changed further toward the outer peripheral direction of the screen than the target positions.

As described above, at the intermediate portion of the screen and at the peripheral portion of the screen, the landing positions of the electron beams which have passed through the shadow mask are changed in the opposite directions, and so-called landing reversal occurs. It is extremely difficult to completely suppress the deterioration in color purity caused by the landing reversal. Usually, attempts to balance the intermediate portion and the peripheral portion of the screen by correction by a holder or the like, have been carried out.

Further, in the case of the shadow mask to be used in the color cathode-ray tube with a flat screen, because the radius of curvature of the mask surface is large, the change in the landing position due to mask doming at the time of thermal expansion markedly increases. Therefore, with such a shadow mask, attempts to suppress mask doming and to suppress the deterioration in color purity by using an extremely low thermal expansion Invar material having a smaller coefficient of thermal expansion than that of Invar material, or the like, have been carried out.

However, the extremely low thermal expansion Invar is a material which is extremely hard to press-mold, and it is extremely difficult to mold a shadow mask having a large radius of curvature at a stable quality. Further, if an expensive material such as the extremely low thermal expansion Invar or the like is used as the shadow mask material which accounts for a large portion of the manufacturing costs of the color cathode-ray tube, the manufacturing costs greatly increase.

BRIEF SUMMARY OF THE INVENTION

The present invention has been contrived in consideration of above-described points, and an object of the present invention is to provide a color cathode-ray tube which can suppress deterioration in color purity without causing an increase in costs.

In order to achieve the above-described object, a color cathode-ray tube according to an aspect of the present invention comprises: a panel having a phosphor screen on an inner surface of the panel; an electron gun located opposite the phosphor screen and configured to emit electron beams toward the phosphor screen; a shadow mask located opposite the phosphor screen and having a large number of electron beam passage apertures through which the electron beams pass; and a substantially rectangular mask frame supporting a peripheral portion of the shadow mask.

The shadow mask includes a substantially rectangular mask main surface having the electron beam passage apertures, and a skirt portion extending from a peripheral edge of the mask main surface in a direction substantially perpendicular to the mask main surface, the mask main surface has a major axis extending perpendicular to a tube axis, a minor axis extending perpendicular to the tube axis and the major axis, and a diagonal axis extending through the tube axis, the skirt portion has a pair of long side skirt portions positioned on both sides of the major axis, a pair of short side skirt portions positioned on both sides of the minor axis, and a plurality of notches extending from an extended edge of the skirt portion toward the peripheral edge of the mask main surface, The notches are formed in the long side skirt portions and the short side skirt portions, and include a plurality of first notches defining first tongue portions respectively at substantially central portions of the respective long side skirt portions and substantially central portions of the respective short side skirt portions, and second notches provided as pairs so as to sandwich respective corner portions of the skirt portion and defining second tongue portions respectively, and the mask frame is disposed at the outside of the skirt portion and welded to the first and second tongue portions.

At the respective corner portions of the skirt portion, when a length from a peripheral edge of the mask surface to welding points of the second tongue portions is Lwd, and a length from the peripheral edge of the mask main surface to a distal end of at least one of the second notches is Lcd, Lcd and Lwd have the relationship of: $Lcd \leqq Lwd \leqq 2Lcd$.

Further, in accordance with a color cathode-ray tube according to another aspect of the present invention, the mask frame has a pair of long side walls facing the long side skirt portions and a pair of long side walls facing the short side skirt portions, and assuming that an angle between the major axis and a diagonal axis connecting a center of the mask frame and a diagonal point at which extensions of the long side walls and the short side walls intersect is θad, and an angle between the major axis and a diagonal welding axis connecting the welding point of the second tongue portion and the center of the mask frame is θwd, θad and θwd have the relationship of $\theta ad < \theta wd$.

According to the color cathode-ray tube structured as described above, by setting the relationship between Lcd and Lwd to $Lcd \leqq Lwd \leqq 2Lcd$, due to thermal expansion of the mask frame, the tensile force applied to the diagonal welding points of the shadow mask is applied to the entire mask main surface, and mask doming is suppressed.

Further, in a laterally-long color cathode-ray tube whose screen size is 4:3 or 16:9, because mask doming is largest on the major axis X, by making the relationship be $\theta ad < \theta wd$, the rigidity in the major axis direction at the corner portions of the skirt portion increases at the diagonal welding points. Therefore, the force of pulling the shadow mask applied in the major axis direction increases, and mask doming in the major axis direction can be effectively suppressed and landing reversal of electron beams at the intermediate and peripheral portions of the screen can be reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently embodiment of the invention, and together with the general description given above and the detailed description of the embodiment given below, serve to explain the principles of the invention.

DETAILED DESCRIPTION OF THE INVENTION

Hereinafter, a color cathode-ray tube according to an embodiment of the present invention, for example, a 19-inch color cathode-ray tube whose ratio of the screen size is 4:3, will be described in detail with reference to the accompanying drawings.

Figure 1:
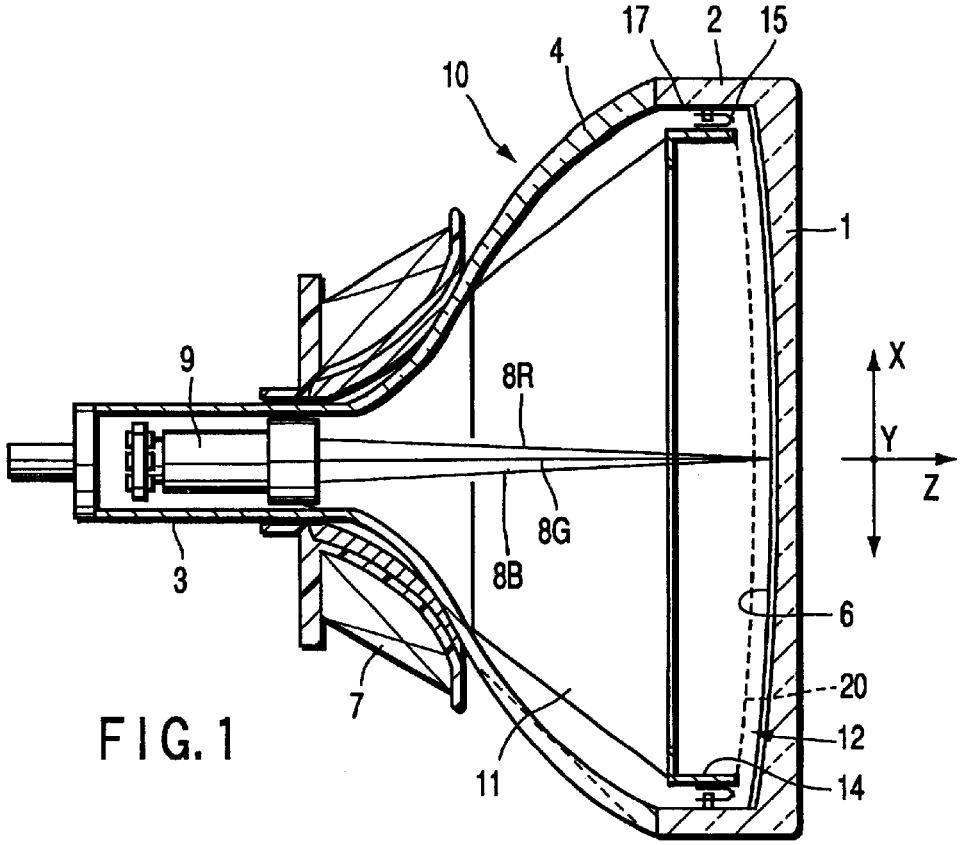
FIG. 1 is a sectional view showing a color cathode-ray tube according to an embodiment of the present invention.

As shown in FIG. 1, the color cathode-ray tube comprises a vacuum envelope 10 formed from glass. The vacuum envelope 10 has a substantially rectangular panel 1 whose outer surface is flat and which has a skirt portion 2 at the peripheral portion, a funnel 4 joined to the skirt portion of the panel, and a cylindrical neck 3 joined to a small-diameter portion of the funnel.

Formed on the inner surface of the panel 1 is a phosphor screen 6 that includes a plurality of dotted or striped phosphor layers, which emit red, green, and blue lights, individually, and black light-shielding layers. A deflection yoke 7 having horizontal and vertical deflection coils is mounted on the outer periphery from the neck 3 to the funnel 4. Further, an electron gun 9 is disposed in the neck 3. The electron gun 9 emits three electron beams arranged in one line, which are a center beam 8G and a pair of side beams 8R, 8B passing on the same horizontal plane, toward the phosphor layers of the phosphor screen 6. Because the loci of the electron beams are changed by effects of magnetic fields, an inner shield 11 shielding external magnetic fields is disposed at the inner side of the joined portion of the panel 1 and the funnel 4.

A shadow mask 12 is provided in the vacuum envelope 10. The shadow mask 12 faces the phosphor screen 6 functioning as a phosphor screen, and is attached to a rectangular mask frame 14. The shadow mask 12, as will be described later, has a mask main surface 20 in which a large number of electron beam passage apertures are formed, and a skirt portion 18 which extends from the peripheral edge of the mask main surface and is fixed to the mask frame 14. The shadow mask 12 is formed by press molding. The shadow mask 12 is detachably supported on the panel 1 in a manner such that elastic support members 15 fixed to the mask frame 14 individually engage stud pins 17 that protrude from the inner surface of the skirt portion 2 of the panel 1.

The vacuum envelope 10 including the panel 1 has a tube axis Z extending so as to pass through the center of the panel and the electron gun 9, a major axis (horizontal axis) X extending perpendicular to the tube axis, and a minor axis (vertical axis) Y extending perpendicular to the tube axis and the major axis.

In the color cathode-ray tube having the above-described structure, the three electron beams 8B, 8G and 8R emitted from the electron gun 9 are deflected by the deflection yoke 7 mounted on the outer side of the funnel 4. The phosphor screen 6 is scanned horizontally and vertically with the electron beams that are passed through the electron beam passage apertures of the shadow mask 12, whereupon a color image is displayed.

Figure 2:
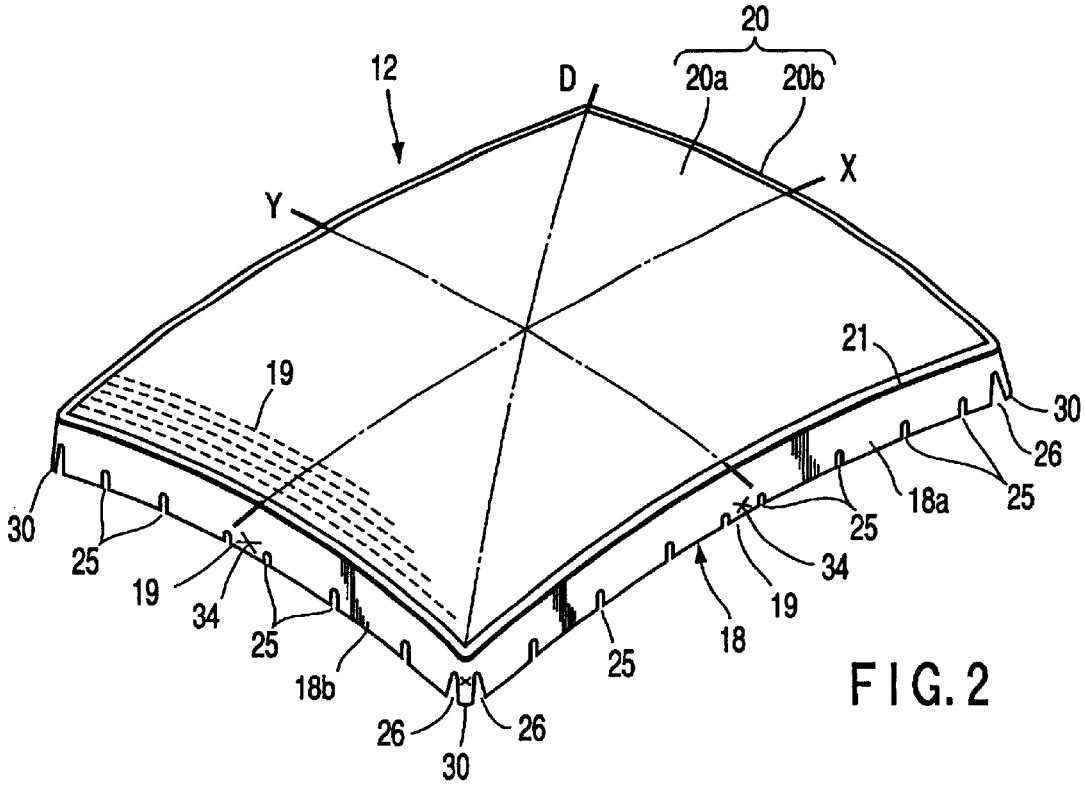
FIG. 2 is a perspective view showing a shadow mask in the color cathode-ray tub;.

As shown in FIG. 2, the shadow mask 12 is formed by press molding, and has the substantially rectangular mask main surface 20 formed in a gently curving dome shape and the skirt portion 18 extending along the entire periphery of the mask main surface, which are formed integrally. The skirt portion 18 extends substantially at right angles to the mask effective portion from its peripheral edge. The mask main surface 20 has a substantially rectangular holed portion 20*a* and a rectangular frame shape non-holed portion 20*b* surrounding the periphery of the holed portion. A large number of electron beam passage apertures 19 are formed at a predetermined arrangement pitch at the holed portion 20*a*.

The skirt portion 18 has a pair of long side skirt portions 18*a* respectively extending from the long sides of the mask main surface 20 and positioned on both sides of the major axis X, and a pair of short side skirt portions 18*b* respectively extending from the short sides of the mask main surface and positioned on both sides of the minor axis Y. A plurality of first notches 25 are formed in the long side skirt portions 18*a* and the short side skirt portions 18*b*, respectively, and extend from the extended edges of the skirt portions toward the peripheral edge 21 of the mask main surface 20. These first notches 25 are disposed so as to be substantially symmetrical with respect to the major axis X, the minor axis Y, and a diagonal axis D of the shadow mask 12. Further, first tongue portions 19 which are welding portions, are formed at the central portions of the respective long side skirt portions 18*a* and the central portions of the respective short side skirt portions 18*b*.

Figure 3:
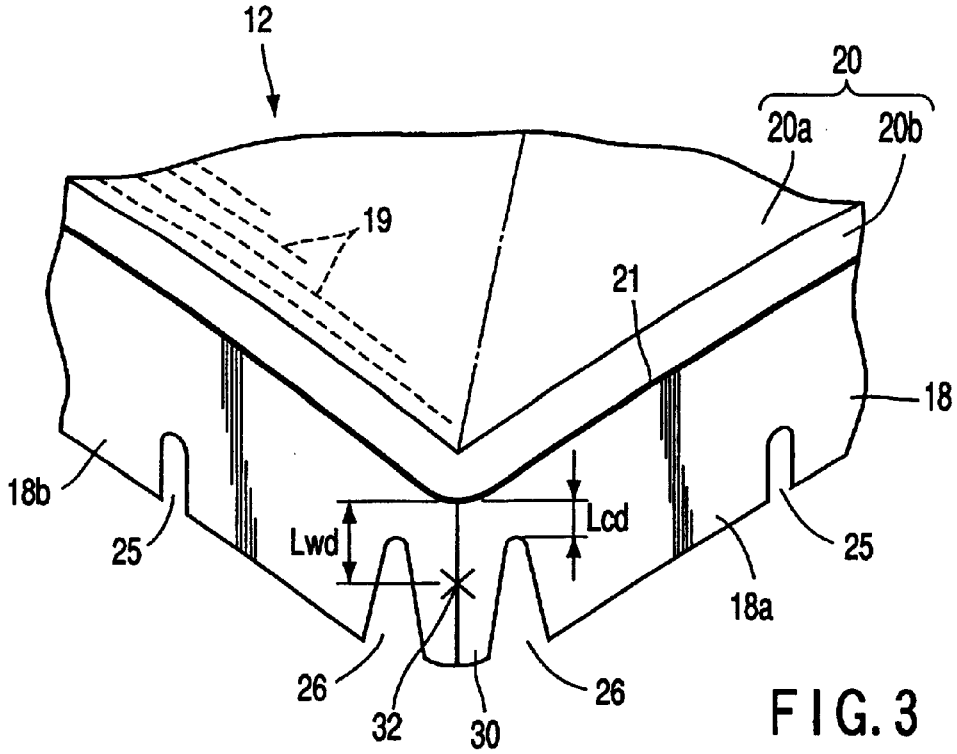
FIG. 3 is a perspective view showing a corner portion of the shadow mask.

As shown in FIG. 2 and FIG. 3, second notches 26 are formed at the both sides of the respective corner portions of the skirt portion 18 and respectively extend from the extended edges of the skirt portion toward the peripheral edge 21 of the mask main surface 20. Further, second tongue portions 30 are defined at the respective corner portions of the skirt portion 18 by these pairs of second notches 26.

Figure 4:
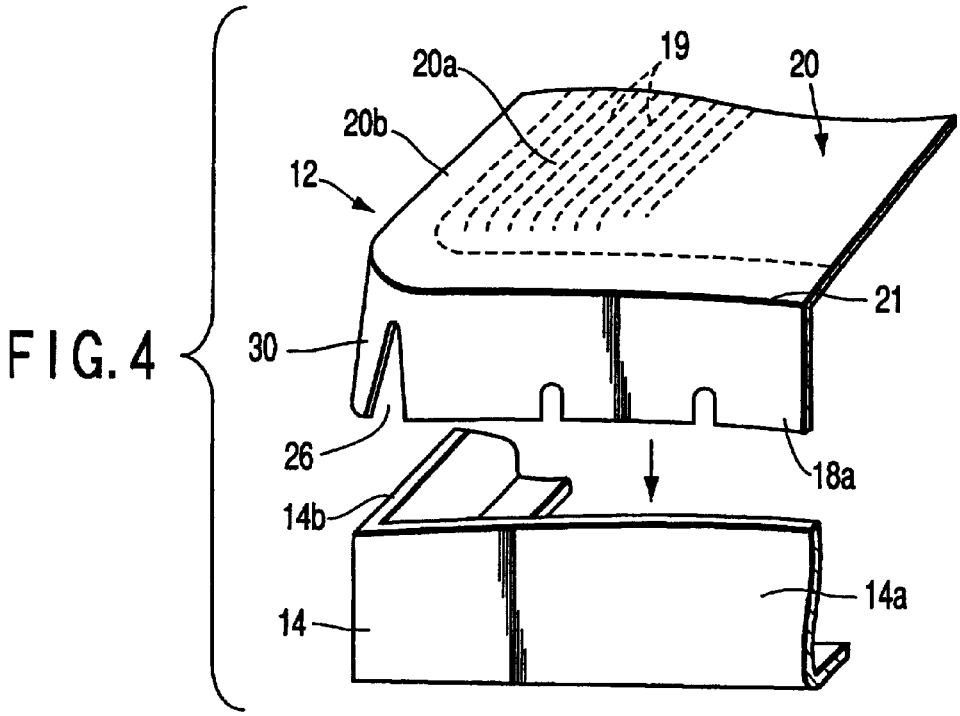
FIG. 4 is an exploded perspective view showing respective one portions of the shadow mask and a mask frame.

As shown in FIG. 1, FIG. 2, and FIG. 4, the mask frame 14 is formed in a rectangular form, and has a pair of long side walls 14*a* and a pair of short side walls 14*b* respectively corresponding to the long side skirt portions 18*a* and the short side skirt portions 18*b* of the shadow mask 12. The above-described shadow mask 12 is disposed at the inside of the mask frame 14, and for example, is welded to the mask frame 14 at eight points which are the first tongue portions 19 positioned at the central portions in the longitudinal direction of the respective long side skirt portions 18*a*, the first tongue portions 19 positioned at the central portions in the longitudinal direction of the respective long side skirt portions 18*b*, and the second tongue portions 30 positioned at the respective corner portions. Note that respective welding points 32, 34 are shown by the X marks.

Next, the respective welding points 32 of the shadow mask 12 will be described in detail. As shown in FIG. 3, at the second tongue portion 30 provided at each corner of the skirt portion 18, assuming that a length from the peripheral edge 21 of the mask main surface 20 to the welding point 32 is Lwd and a length from the peripheral edge 21 to the upper end of the second notch 26 is Lcd, the welding point 32 and the second notch 26 are set so as to satisfy the relationship of:

$$Lcd \leqq Lwd \leqq 2Lcd.$$

Note that, in the present embodiment, at each corner portion of the skirt portion 18, each of the pairs of notches 26 positioned on both sides of the second tongue portion 30 and the welding point 32 are respectively set to satisfy the above-described relationship. However, it suffices that at least one of the second notches 26 satisfies the above-described relationship.

Figure 5:
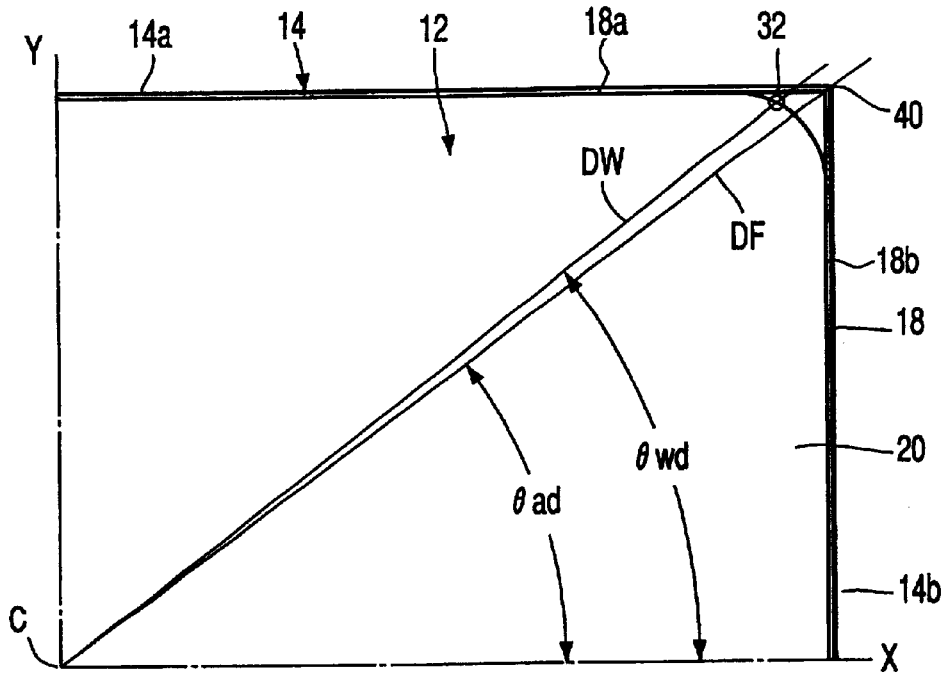
FIG. 5 is a plan view showing positions of diagonal welding points of the corner portion of the shadow mask and the mask frame.

As shown in FIG. 5, assuming that an angle between the major axis X and a diagonal axis DF connecting a center C of the mask frame 14 and a diagonal corner point 40 at which the long side wall 14*a* and the short side wall 14*b* of the mask frame 14 intersect is θad, and an angle between the major axis X and a diagonal welding axis DW extending through the center C of the mask frame and the welding point 32 is θwd, the welding point 32 at each corner portion of the skirt portion 18 is set so as to satisfy the relationship of:

$$\theta ad < \theta wd, \text{ and preferably } \theta ad < \theta wd < 1.2\theta ad.$$

Figure 6:
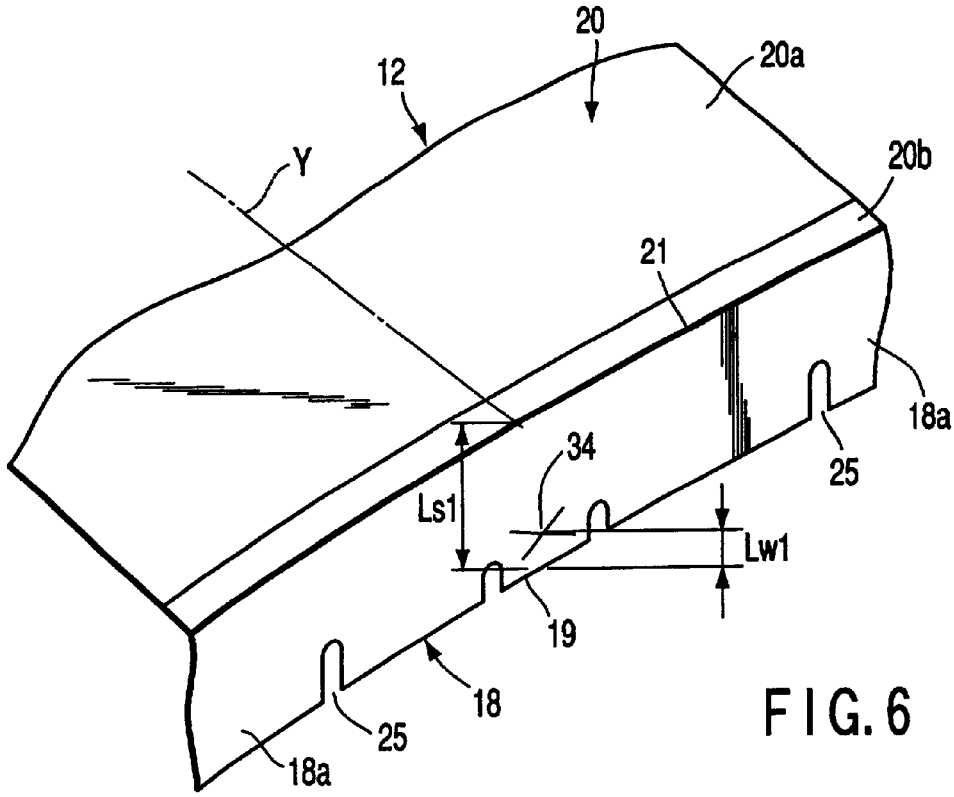
FIG. 6 is a perspective view showing welding points of a skirt portion at respective long sides of the shadow mask.

On the other hand, as shown in FIG. 2 and FIG. 6, assuming that a length from the extended edge of the skirt portion to the welding point 34 is Lw1, and a length from the peripheral edge 21 of the mask main surface 20 to the extended edge of the skirt portion 18 is Ls1, the welding points 34 of the respective long side skirt portions 18*a* and short side skirt portions 18*b* of the skirt portion 18 are set to satisfy the relationship of:

$$Lw1 \leqq Ls1/3.$$

Note that, although FIG. 6 shows the welding point 34 of the long side skirt portion 18*a*, the welding point 34 of the short side skirt portion 18*b* as well is set to satisfy the above-described relationship.

In the color cathode-ray tube having the shadow mask 12 of the above-described structure, the length Lcd from the peripheral edge 21 of the mask main surface 20 to the upper end of the second notch 26 was fixed to, for example, 3 mm, and the color offset characteristic (PD amount) at the time of changing Lwd was investigated. At this time, the PD amount of the intermediate portion of the screen spaced by 140 mm from the center of the screen toward the major axis X end (hereinafter called PDh-M), and the PD amount of the major axis end portion of the screen spaced by 180 mm from the center of the screen toward the major axis X end (hereinafter called PDh-E) were investigated.

Figure 7:
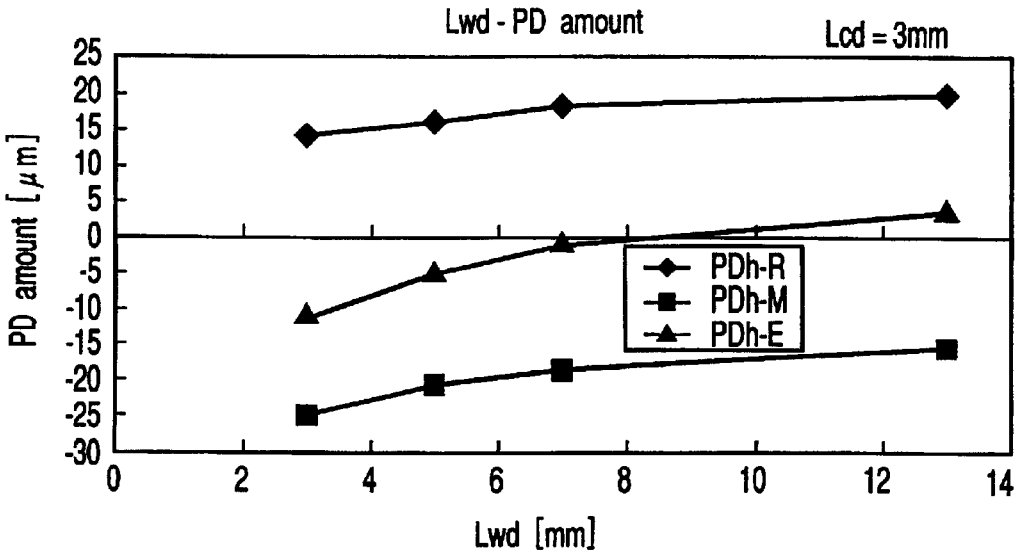
FIG. 7 is a graph showing the relationship between Lwd and the PD amount of the shadow mask.

As a result, as shown in FIG. 7, with respect to the PD reversal amount (hereinafter called PDh-R) which is the difference between the PDh-M amount and the PDh-E amount at the time of displaying a high-luminance image, assuming that the inner direction of the screen is minus and the outer direction of the screen is plus, and the shorter Lwd is, the smaller PDh-R is, and the longer Lwd is, the larger PDh-R is. However, if Lwd is made to be too short, although PDh-R is small, PDh-E is too large.

Accordingly, the relationship between Lcd and Lwd is preferably set to:

$$Lcd \leqq Lwd \leqq 2Lcd.$$

Note that, in the present embodiment, Lwd=5 mm.

When the Lcd of the skirt portion 18 is lengthened, the strength of the diagonal portion of the mask skirt portion increases. The strength of welding at the corner portions of the skirt portion 18 and the mask frame 14 can be adjusted by adjusting the Lcd.

Figure 8:
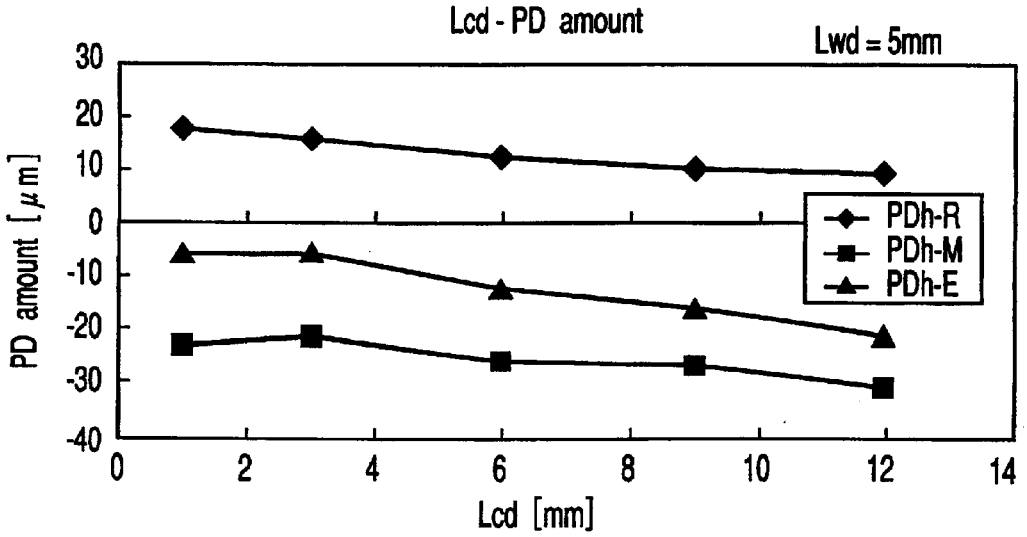
FIG. 8 is a graph showing the relationship between Lcd and the PD amount of the shadow mask.

As shown in FIG. 8, as a result of investigating the PD amount while changing Lcd in a state in which Lwd was fixed at Lwd=5 mm, the longer Lcd is, the more PDh-R decreases. However, PDh-E at the time of displaying a high-luminance image increases. Further, if Lcd is 1 mm or less, the rigidity of the shadow mask itself deteriorates, and handling and workability of the shadow mask in a production line deteriorate. Further, if the length of Lcd is 5 mm or more, the moldability of the shadow mask deteriorates. From this, Lcd is preferably 2 mm or more, and in the present embodiment, Lcd=3 mm.

Figure 9:
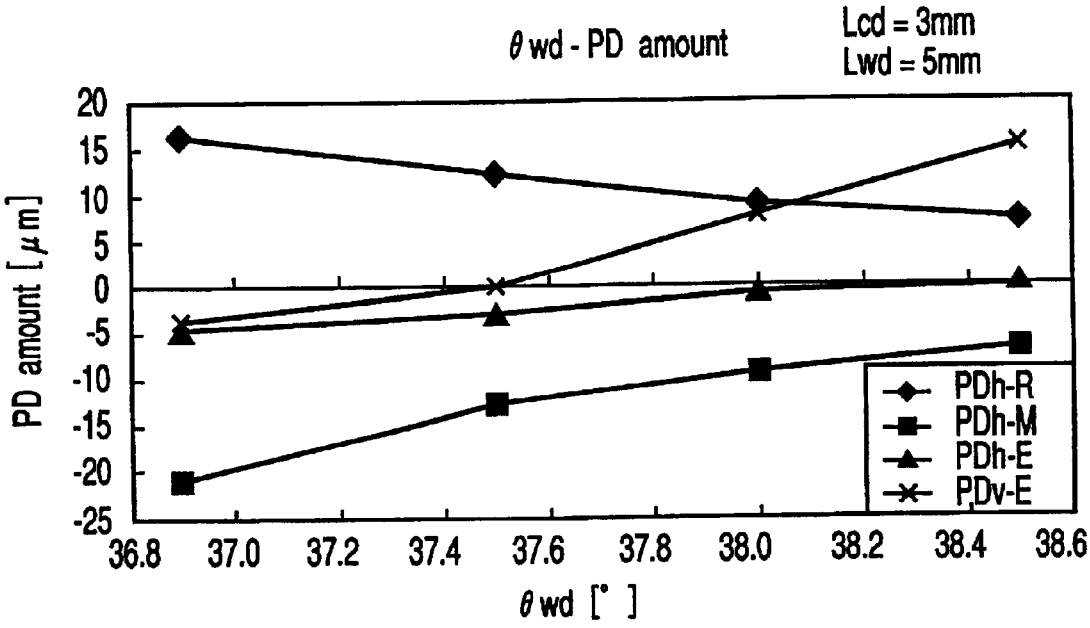
FIG. 9 is a graph showing the relationship between θwd and the PD amount of the shadow mask.

Moreover, as a result of investigating the PD characteristic while changing θwd in a state of fixing Lwd=5 mm and Lcd=3 mm, as shown in FIG. 9, if θwd is made large, although PDh-M, PDh-E, and PDh-R decrease gradually, the PD amount at the vicinity of the end of the minor axis Y of the screen (hereinafter called Pdv-E) deteriorates markedly. Therefore, the relationship is set to:

$\theta ad < \theta wd$, and preferably, to $\theta ad < \theta wd < 1.2\theta ad$, and in the present embodiment, $\theta wd = 37.5°$, and $\theta ad = 36.9°$.

Further, at the shadow mask 12, the welding points 34 between the long side skirt portions 18*a* of the skirt portion 18 and the mask frame 14, and the welding points 34 between the short side skirt portions 18*b* and the mask frame are preferably provided at positions as close as possible to the extended edge of the skirt portion 18.

This is because, if the skirt portion 18 is pulled toward the outer side by thermal expansion of the mask frame 14 at the respective welding points 34 of the skirt portion 18, local deformation in the curved surface generate at the peripheral edge portion of the mask main surface 20 due to the bending moment of the skirt portion 18, and the color purity deteriorates.

Here, the welding points 34 of the respective long side skirt portions 18*a* and the respective short side skirt portions 18*b* are provided so as to satisfy the relationship of $Lw1 \leqq Ls1/3$. In the present embodiment, Lw1=17 mm, and Ls1=3 mm.

According to the color cathode-ray tube structured as described above, when the tensile force is applied to the shadow mask 12 due to thermal expansion of the mask frame 14, in particular, when the force of pulling the shadow mask is applied to the welding points of the respective corner portions of the mask skirt portion, the force is applied to the entire curved surface of the shadow mask, and doming of the shadow mask can be effectively suppressed.

Further, in a laterally-long color cathode-ray tube whose screen size is 4:3 or 16:9, mask doming is largest on the horizontal axis, namely, on the major axis X. Therefore, by making the welding points of the corner portions be $\theta D < \theta DW$, the rigidity in the major axis direction of the mask skirt at the corner portions of the mask skirt portion increases. Accordingly, the force of pulling the shadow mask applied in the major axis direction increases, and mask doming in the major axis direction can be suppressed.

However, if the welding points at the long side skirt portions and the short side skirt portions of the shadow mask are set close to the peripheral edge of the mask surface, thermal expansion of the mask frame is applied to the shadow mask only at vicinities of the welding points of the skirt portion, and local deterioration in color purity arises.

Therefore, by making $Lw1 \leqq Ls1/3$ and setting the distances between the welding points of the long side and short side skirt portions and the mask main surface to be long, local deformation of the mask main surface at the time of expansion of the mask frame can be prevented. As the result, landing reversal of electron beams at the intermediate and peripheral portions of the screen can be reduced, and deterioration of color purity can be suppressed.

In accordance with the above description, it is possible to prevent fluctuations in the space (q value) between the phosphor screen and the shadow mask due to doming of the shadow mask, and to suppress deterioration of color purity of a displayed image. Further, as the shadow mask material, a conventional Invar material can be used, and an increase in the manufacturing costs is not caused.

Figure 10:
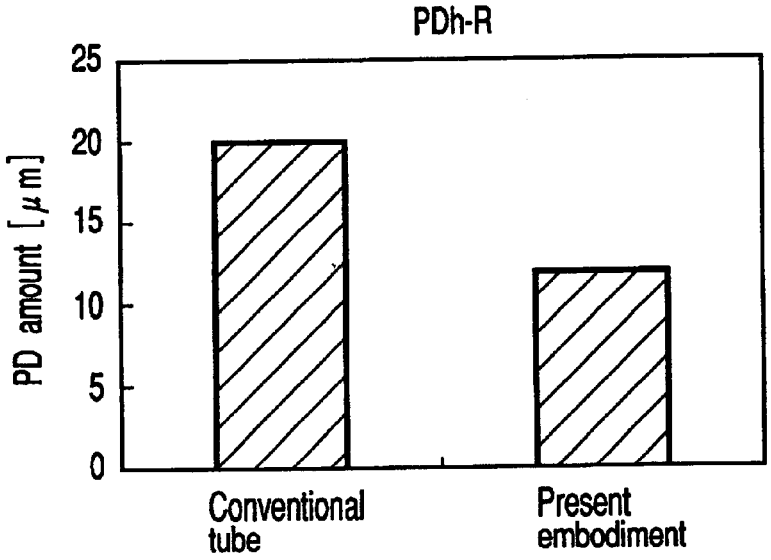
FIG. 10 is a graph showing, in comparison, PDh-R of the color cathode-ray tube according to the embodiment and PDh-R of a conventional color cathode-ray tube.

Comparing the PDh-R of the color cathode-ray tube according to the present embodiment and the PDh-R of a conventional color cathode-ray tube, as shown in FIG. 10, in the color cathode-ray tube according to the present embodiment, the PD reversal amount is reduced by about 40% by suppressing the mask doming.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

For example, the number, depth, and the like of the notches provided at the skirt portion 18 are not limited to those in the embodiments described above, and can be changed as needed.

What is claimed is:

1. A color cathode-ray tube comprising:

a panel having a phosphor screen on an inner surface of the panel;

an electron gun located opposite the phosphor screen and configured to emit electron beams toward the phosphor screen;

a shadow mask located opposite the phosphor screen and having a large number of electron beam passage apertures through which the electron beams pass; and a substantially rectangular mask frame supporting a peripheral portion of the shadow mask, the shadow mask including a substantially rectangular mask main surface having the electron beam passage apertures, and a skirt portion extending from a peripheral edge of the mask main surface in a direction substantially perpendicular to the mask main surface, the mask main surface having a major axis extending perpendicular to a tube axis, a minor axis extending perpendicular to the tube axis and the major axis, and a diagonal axis extending through the tube axis, the skirt portion having a pair of long side skirt portions positioned on both sides of the major axis, a pair of short side skirt portions positioned on both sides of the minor axis, and a plurality of notches extending from an extended edge of the skirt portion toward the peripheral edge of the mask main surface, the notches being formed in the long side skirt portions and the short side skirt portions, and including a plurality of first notches defining first tongue portions respectively at substantially central portions of the respective long side skirt portions and substantially central portions of the respective short side skirt portions, and second notches provided as pairs so as to sandwich respective corner portions of the skirt portion and defining second tongue portions respectively, the mask frame being disposed at the outside of the skirt portion and welded to the first and second tongue portions, and at the respective corner portions of the skirt portion, when a length from a peripheral edge of the mask surface to welding points of the second tongue portions is Lwd, and a length from the peripheral edge of the mask main surface to a distal end of at least one of the second notches is Lcd, Lcd and Lwd have the relationship of:

$$Lcd \leqq Lwd \leqq 2Lcd.$$

2. A color cathode-ray tube according to claim 1, wherein the mask frame has a pair of long side walls facing the long side skirt portions and a pair of long side walls facing the short side skirt portions, and when an angle between the major axis and a diagonal axis connecting a center of the mask frame and a diagonal point at which extensions of the long side walls and the short side walls intersect is θad, and an angle between the major axis and a diagonal welding axis connecting the welding point of the second tongue portion and the center of the mask frame is θwd, θad and θwd have the relationship of:

$$\theta ad < \theta wd.$$

3. A color cathode-ray tube according to claim 2, wherein θad and θwd have the relationship of:

$$\theta ad < \theta wd \leqq 1.2\theta ad.$$

4. A color cathode-ray tube according to claim 1, wherein, when, at each of the first tongue portions, a length from the extended edge of the skirt portion to the welding point is Lw1, and a length from the peripheral edge of the mask main surface to the extended edge of the skirt portion is Ls1, Lw1 and Ls1 have the relationship of:

$$Lw1 \leqq Ls1/3.$$

5. A color cathode-ray tube according to claim 1, wherein the panel has a substantially flat outer surface.

6. A color cathode-ray tube according to claim 2, wherein, when, at each of the first tongue portions, a length from the extended edge of the skirt portion to the welding point is Lw1, and a length from the peripheral edge of the mask main surface to the extended edge of the skirt portion is Ls1, Lw1 and Ls1 have the relationship of:

$$Lw1 \leqq Ls1/3.$$

7. A color cathode-ray tube according to claim 2, wherein the panel has a substantially flat outer surface.

8. A color cathode-ray tube according to claim 3, wherein, when, at the first tongue portion, a length from the extended edge of the skirt portion to the welding point is Lw1, and a length from the peripheral edge of the mask main surface to the extended edge of the skirt portion is Ls1, Lw1 and Ls1 have the relationship of:

$$Lw1 \leqq Ls1/3.$$

* * * * *